US007528726B2

(12) United States Patent
Lee et al.

(10) Patent No.: US 7,528,726 B2
(45) Date of Patent: May 5, 2009

(54) RFID PORTAL ARRAY ANTENNA SYSTEM

(75) Inventors: Teh-Hong Lee, Dublin, OH (US); Walter D. Burnside, Dublin, OH (US); Robert J. Burkholder, Columbus, OH (US); Chan-Ping Edwin Lim, Hilliard, OH (US)

(73) Assignee: YEON Technologies Co., Ltd., Taipei (TW)

( * ) Notice: Subject to any disclaimer, the term of this patent is extended or adjusted under 35 U.S.C. 154(b) by 0 days.

(21) Appl. No.: 11/753,487

(22) Filed: May 24, 2007

(65) Prior Publication Data

US 2007/0273529 A1 Nov. 29, 2007

Related U.S. Application Data

(60) Provisional application No. 60/808,897, filed on May 26, 2006.

(51) Int. Cl.
*G08B 13/14* (2006.01)

(52) U.S. Cl. ..... 340/572.7; 340/572.4; 340/572.8; 340/10.1

(58) Field of Classification Search ..... 340/572.7, 340/572.4, 572.8, 10.1, 10.34, 10.4; 235/385; 343/700 M, 745, 845, 795
See application file for complete search history.

(56) References Cited

U.S. PATENT DOCUMENTS

| | | | | |
|---|---|---|---|---|
| 4,016,553 | A * | 4/1977 | Novikoff et al. | 340/572.7 |
| 5,576,710 | A * | 11/1996 | Broderick et al. | 342/1 |
| 5,592,177 | A * | 1/1997 | Barrett | 342/361 |
| 6,049,278 | A * | 4/2000 | Guthrie et al. | 340/572.7 |
| 6,535,175 | B2 * | 3/2003 | Brady et al. | 343/795 |
| 7,034,688 | B2 * | 4/2006 | Rietzler et al. | 340/572.7 |
| 7,180,423 | B2 * | 2/2007 | Forster et al. | 340/572.7 |

OTHER PUBLICATIONS

International Search Report, Jul. 21, 2008, 8 pages.

* cited by examiner

*Primary Examiner*—Anh V La
(74) *Attorney, Agent, or Firm*—Holland & Knight LLP; Brian J Colandreo, Esq.

(57) ABSTRACT

This invention provides an array antenna for a radio frequency identification (RFID) system, the array antenna comprises a transmission line with a longitudinal span proximately equaling to a height of a space desired to be covered by the array antenna, the transmission line having a terminal coupled to a RFID reader, and a plurality of radiating elements disposed on the first transmission line along the longitudinal span, additionally, reflective materials used behind the array antenna to maximize the illumination in the desired space and absorptive materials installed surrounding the desired space, in order to minimize the illumination of the undesired space surrounding the desired space.

20 Claims, 4 Drawing Sheets

RFID PORTAL ARRAY ANTENNA SYSTEM

CROSS REFERENCE

The present application claims the benefits of U.S. Provisional Application Ser. No. 60/808,897, which was filed on May 26, 2006. There are also two co-pending application Ser. No. 11/690,562, filed Mar. 23, 2007, and Ser. No. 11/750,307, filed on May 17, 2007, which are incorporated by reference in its entirety.

BACKGROUND

The present invention relates generally to radio frequency identification (RFID) antennas, and more specifically, to RFID antennas arranged in arrays.

A RFID system uses radio frequency transmission to identify, categorize, locate and track objects. The RFID system comprises two primary components: a transponder or the RFID tag and a reader. The tag is a device that generates electrical signals or pulses interpreted by the reader. The reader is a transmitter/receiver combination (transceiver) that activates and reads the identification signals from the transponder. The RFID tags are attached to objects that need to be tracked, and can be programmed to broadcast a specific stream of data denoting the object's identity, such as serial and model numbers, price, inventory code and date. A reader will detect the "tagged" object and further connects to a large network that will send information on the objects to interested parties such as retailers and product manufacturers. The RFID tags are considered to be intelligent bar codes that can communicate with a networked system to track every object associated with a designated tag. Therefore, the RFID tags are expected to be widely used in supply chain management, such as tracking shipping and handling. In such supply chain management applications, merchandize are often packed in pallets or large piles of containers. Conventional horn antennas have been used in such supply chain management applications. FIG. 1 shows a horn antenna 110, which is connected with a RFID reader 120, that broadcasts radio frequency (RF) energy toward a pallet 130 packed with RFID tagged merchandise. Due to the nature of the horn antenna 110, the broadcasted RF energy beams out in a large fan-out way. For the large pallet 130, the RF signal strength is not uniform, i.e., not all the RFID tagged items in the pallet 130 may be read. It is certainly not efficient in terms of transmitting and receiving RF signals. Besides, such a horn antenna tends to read any tagged items within a certain range, even those that are outside the pallet 130 and not intended to be read.

In view of the above applications, there is clearly a need to develop a RFID antenna system that facilitates reading 100% of the tagged items in a desired object space, and 0% in undesired spaces. If a pallet is the desired object space, then any space outside of the pallet is the undesired space.

SUMMARY

This invention provides an array antenna for a radio frequency identification (RFID) system. According to a first embodiment of the present invention, the array antenna comprises a transmission line with a longitudinal span proximately equaling to a height of a space desired to be covered by the array antenna, the transmission line having a terminal coupled to a RFID reader, and a plurality of radiating elements disposed on the first transmission line along the longitudinal span, wherein the desired space is proximately evenly covered by radiations from the plurality of radiating elements.

According to a second embodiment of the present invention the array antenna comprises a first transmission line with a first longitudinal span proximately equaling to a height of a space desired to be covered by the array antenna, a first plurality of radiating elements disposed on the first transmission line along the first longitudinal span, a second transmission line having a second longitudinal span also proximately equaling to the height of the desired space, the second transmission line being substantially parallel to the first transmission line, yet separated from the first transmission line by a first predetermined distance in a horizontal direction, and a second plurality of radiating elements disposed on the second transmission line along the second longitudinal span, vertically adjacent radiating elements of both the first and second plurality of radiating elements being separated by at least one second predetermined distance in the vertical direction, wherein the desired space is proximately evenly covered by radiations from both the first and second plurality of radiating elements.

According to a third embodiment of the present invention, the antenna system of the second embodiment is mounted near absorptive panels that are used to attenuate the undesired radiations from the antenna system and the scattering from the pallet illuminating nearby tagged items that are not located on the pallet being interrogated by the antenna system.

According to a fourth embodiment of the present invention, the absorptive panels described earlier should not be placed directly next to the antenna system because it will impact its radiation performance, a conducting panel should be placed directly behind the antennas to re-direct the antenna back radiation toward the pallet being measured.

The construction and method of operation of the invention, however, together with additional objects and advantages thereof will be best understood from the following description of specific embodiments when read in connection with the accompanying drawings.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein. It should be noted that the features illustrated in the drawings are not necessarily drawn to scale.

DESCRIPTION

The present invention provides a RFID array antenna system that has good selective coverage, i.e., a complete coverage in a desired space, and very little coverage in spaces outside the desired space.

Figure 1:
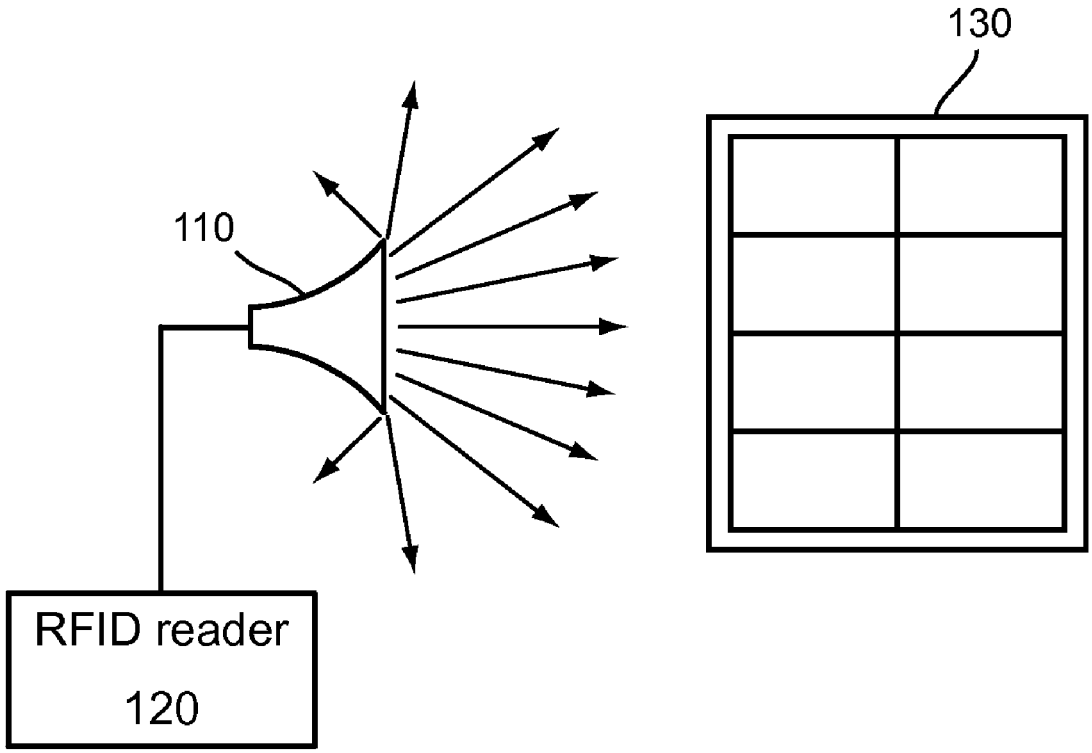
FIG. 1 (Prior Art)
FIG. 1 illustrates a conventional RFID reader with a horn antenna.
Figure 2:
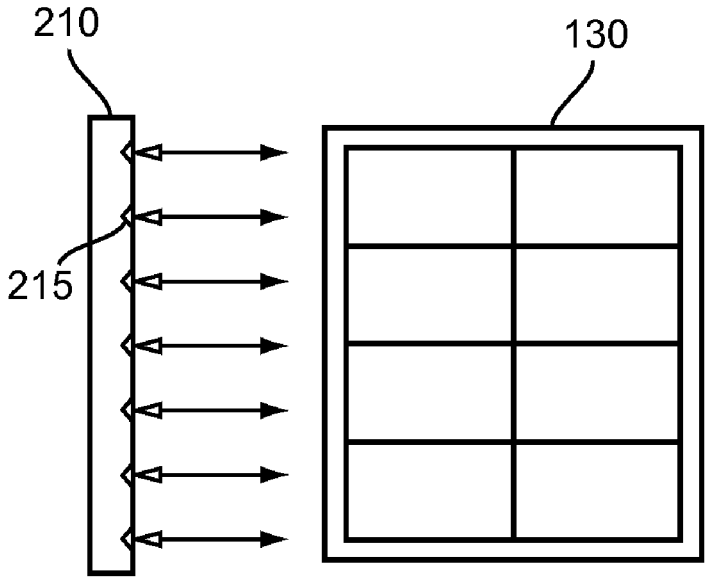
FIG. 2 illustrates a basic array antenna for transmitting radio frequency identification (RFID) signal to a pallet according to a first embodiment of the present invention.

FIG. 2 illustrates a basic array antenna 210 for transmitting a radio frequency identification (RFID) signal to a pallet 130 according to a first embodiment of the present invention. The antenna 210 has an array of relatively closely spaced radiators 215 transmitting a plane wave or nearly a plane wave of the RFID signal. For a given transmitting energy level, tagged items in the pallet 130 will receive the RFID signal with higher energy. Therefore, such an array antenna functions better than the conventional horn antenna in reading the pallet 130.

A RFID system is a backscatter system, in which signals transmitted to a RFID tag, being modulated thereby, and then scattered back to a reader antenna. The transmission power is greatly attenuated during propagating to and from the tag antenna without even considering the additional loss associated with the tag antenna efficiency in creating the modulation. As a result, the backscattered signal is extremely weak. Therefore, a RFID reader needs to radiate significant power and has to have a very low-noise receiver to provide an adequate dynamic range. In order to improve the system signal-to-noise ratio, the present invention proposes to use multiple independent ports, including respective antennas, for the RFID system. Having multiple independent RFID antenna ports is clearly superior to the conventional single port antenna RFID reader system.

Figure 3A:
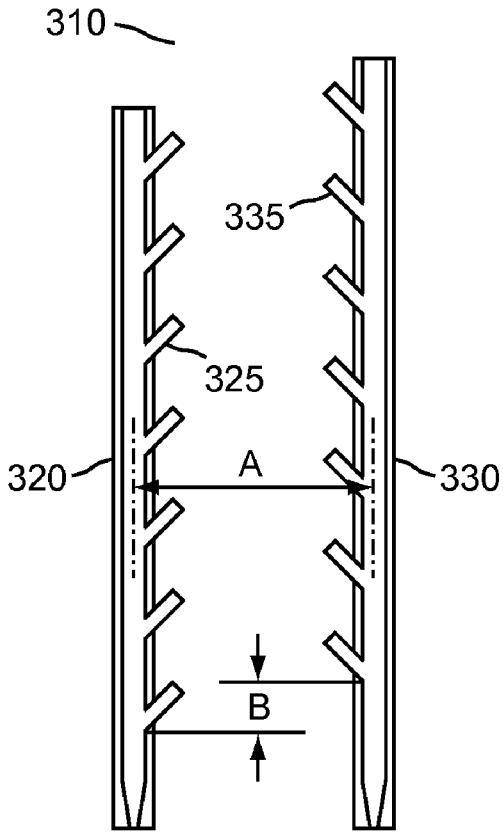
FIG. 3A illustrates an improved RFID array antenna according to a second embodiment of the present invention.

FIG. 3A illustrates an improved array antenna 310 according to a second embodiment of the present invention. The improved array antenna 310 has two arrays, 320 and 330, located side-by-side with a 5" horizontal separation distance (A). Radiators 325 on the array 320 radiate a +45° polarization signal. Radiators 335 on the array 330 radiate a −45° polarization signal. The radiators 325 and 335 have a 4" vertical separation distance (B). A wavelength of a typical RFID signal is about 13". Keeping the radiator separation on the order of the wavelength, the RFID signal will maintain radiations from these radiators being in phase, so that they may not cancel out each other. While the radiators angles, 325 and 335, provide polarization diversity, the radiator separations provide spatial diversity.

Each array, 320 or 330, of the antenna system 310 may be constructed in the same way as the shelf antenna disclosed by Burnside et al., also inventors of the present invention, in a U.S. patent application Ser. No. 11/750,307, filed on May 17, 2007. The radiating elements of the array antenna may be protruding conductive strips coupled to a top plate of the distributed antenna. The coupling between the conductive strips and the top plate may be accomplished through a direct electrical connection, capacitive coupling or inductive coupling. Skilled artisan may also appreciate conductive patches or conductive loops may also serve as the radiating elements. The conductive patches or the conductive loops may be coupled to the top plate by electrical connection, capacitive coupling or inductive coupling.

Figure 3B:
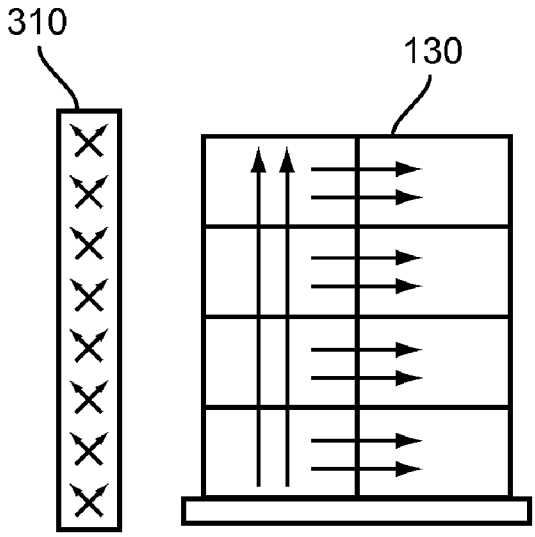
FIG. 3B illustrates that the improved RFID array antenna of FIG. 3A is used to read a pallet.

FIG. 3B illustrates that the improved array antenna 310 of FIG. 3A that is used to read the pallet 130. Both the +45° and −45° polarization signals excite the horizontal and vertical gaps between the containers in the pallet 130 equally well. Thus, both the arrays 320 and 330 of the antenna system 310 of FIG. 3A are expected to create RFID signals that permeate the pile of the containers, even if these containers are filled with large conducting structures.

In another application, two RFID reader antenna systems are used to interrogate a pile of containers. One reader antenna system is located on either side of the pile or even on the top and bottom of the pile as well. These antenna systems can be connected to the RFID reader system through different ports. As a result, these multiple antenna systems can interrogate different sides of the pile as it passes by these antennas. This will greatly improve the illumination of all sides of the pile and provide much higher read rates for the tagged items located within the pile.

As stated earlier, there can be significant interference between closely-spaced RFID reader systems. Yet, in another application, identical RFID readers of different networks may be placed close to each other. For instance, adjacent warehouse doorways may have identical RFID systems. Since these doorways are very close together, one must isolate these multiple systems from interferences between adjacent RFID readers as well as undesired reflections from containers. Especially considering that the reflections from containers are often times uncontrollable. As a result, the present invention proposes to integrate some absorptive material close to the antenna array, so that much of the reflected signals will be absorbed before reaching the adjacent reader antenna system.

Figure 4:
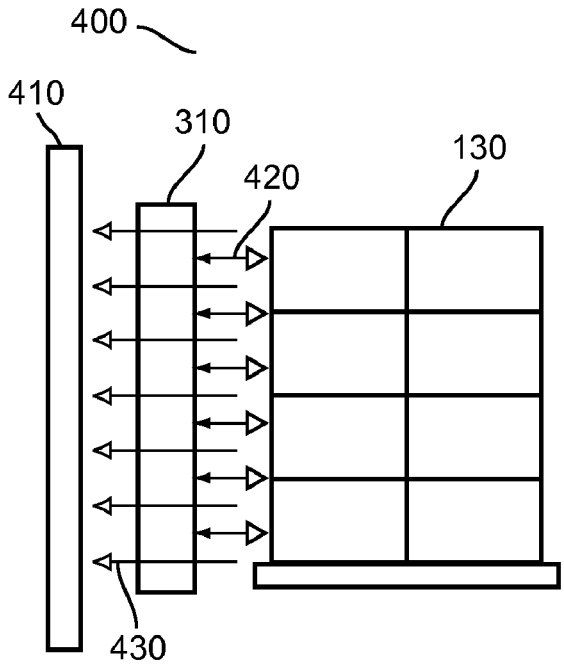
FIG. 4 illustrates a RFID array antenna system with an absorptive panel disposed nearby according to a third embodiment of the present invention.

FIG. 4 illustrates an RFID array antenna system 400 with an absorptive panel 410 disposed nearby according to a third embodiment of the present invention. A RFID signal 420 is transmitted and received by the array antenna 310. When hitting the absorptive panel 410, an undesired reflective signal 430 from the pile 130 is strongly attenuated thereby, so that it does not illuminate any adjacent RFID reader antenna system. The absorptive panel 410 can be made of traditional RF absorbers or layers of thin resistive sheets separated by a low loss material such as foam. The array antenna 310 and the absorptive panel 410 form an ideal illuminator satisfying both good illumination and low interference requirements normally associated with present-day RFID pallet reader systems. Although the absorptive panel 410, as shown in FIG. 4, is disposed behind the array antenna 310, a skilled artisan would place the absorptive panel 410 wherever the undesired reflective signal 430 needs to be attenuated.

A RFID portal system is a special kind of RFID pallet reader system in which the RFID reader is stationed in a doorway, for instance. The RFID portal system performs a read when a pallet passes through the RFID portal system. A design goal is, apparently, to fully read all the tagged items contained within the pallet, and read nothing outside of the pallet. The array antenna system 400 of FIG. 4 may be used in the RFID portal system. However, the absorber treatment must be designed in such a way that the desired illumination of the pallet is unaffected. In order to accomplish this goal, one must first understand what needs to be absorbed and not absorbed. The desired signal is rather obvious, in that it propagates outward from the reader antenna toward the pallet. Undesired signals that need to be absorbed come from the stray radiation of the reader antenna and pallet scattering. Note that the scattering from the pallet can be very significant especially when the pallet contains large metallic structures. Since the portal system must function well under all circumstances, one must therefore assume that the pallet scattering is very significant. Then the portal reader system must be surrounded by a structure that will reflect and/or absorb this pallet scattering before it illuminates the surrounding area. Thus, this structure must be of some reasonable size, surround the pallet on as many sides as possible and contain sufficient absorber to attenuate the undesired signals outside the portal structure.

The desired signal directly illuminates the pallet, which is located right in front of the reader antenna of such a portal system. Since the radiation level of the portal system is limited by regulatory agencies, the presence of the absorptive panels will inevitably lower the desired signal level as well. In order to alleviate such a negative effect, the absorptive panels should be disposed not in the immediate surroundings of the portal array antenna. In fact, it is the best if the portal reader antenna is mounted in front of a reflective metal panel so that a back radiation from the portal reader antenna is reflected toward the pallet to enhance the illumination of the pallet.

Figure 5:
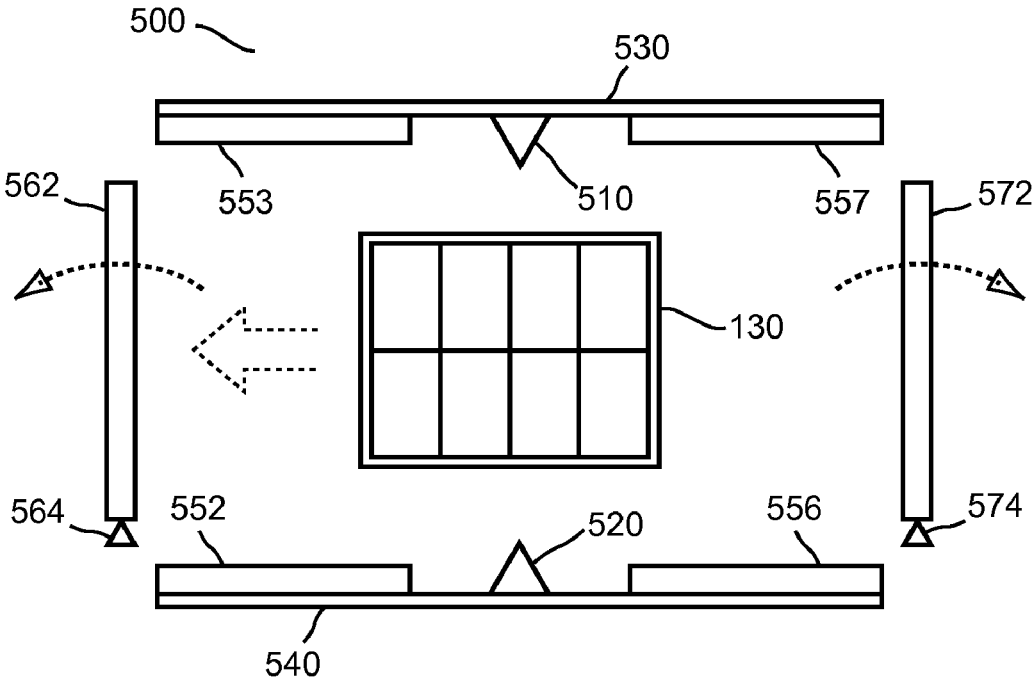
FIG. 5 is a top view of a portal structure with reader antennas backed by reflective panels according to a fourth embodiment of the present invention.

FIG. 5 is a top view of a portal structure 500 with reader antennas 510 and 520 backed by reflective panels 530 and 540, respectively, according to a fourth embodiment of the present invention. The dual antennas 510 and 520 on both sides of the portal structure 500 form a reader network to provide better coverage of passage space between the two sides of the portal structure 500. The pallet 130 is shown to be moving through the passage space. Both antennas 510 and 520 are array antennas similar to the one shown in FIG. 3A. Absorptive panels 553 and 557 are disposed on the same side of the portal structure 500 as the antenna 510, exposing a portion of the reflective panel 530 right behind the antenna 510. This exposed portion of the reflective panel 530 serves to reflect the back radiation of the antenna 510 to the passage space. Similarly, absorptive panels 552 and 556 are disposed on the same side of the portal structure 500 as the antenna 520, exposing a portion of the reflective panel 540 right behind the antenna 520. This exposed portion of the reflective panel 540 serves to reflect the back radiation of the antenna 520 to the passage space. The absorptive panels, 553, 557, 552 and 556, absorb scattered RFID signals. The dimension of the exposed portions depends on the size of the pallet 130 that the portal structure 500 caters to. In addition to the side absorptive panels 553, 557, 552 and 556, the portal structure may also include a front panel 562 and a back panel 572. The front panel 562 can swing open on a hinge 564 or simply get pushed out of the way being a light-weight flexible material, so does the back panel 572 on a hinge 574 to allow the pallet 130 to move in and out of the passage space. The front and back panels 562 and 572, respectively, can be either reflective or absorptive depending on whether illumination or interference is more of an issue in a particular application. The portal structure 500 may also have a top panel (not shown) and a bottom panel (not shown). Both the top and bottom panels can be reflective, absorptive or both and can even also include an antenna system. In any event, these treatment panels, front, back, top or bottom, can isolate the passage space from its surrounding environment.

The portal structure 500 as shown in FIG. 5 has to be able to handle a very rough environment including large and very heavy pallets, pallet movers, forklifts, etc. The absorptive panels 553, 557, 552 and 556 must be constructed out of materials that are structurally sound. Most commercial absorbers are not able to withstand such an environment. One way to solve the problem is to use a durable cover to protect such commercial absorbers. Another way is to seek more suitable materials and structures.

Figure 6:
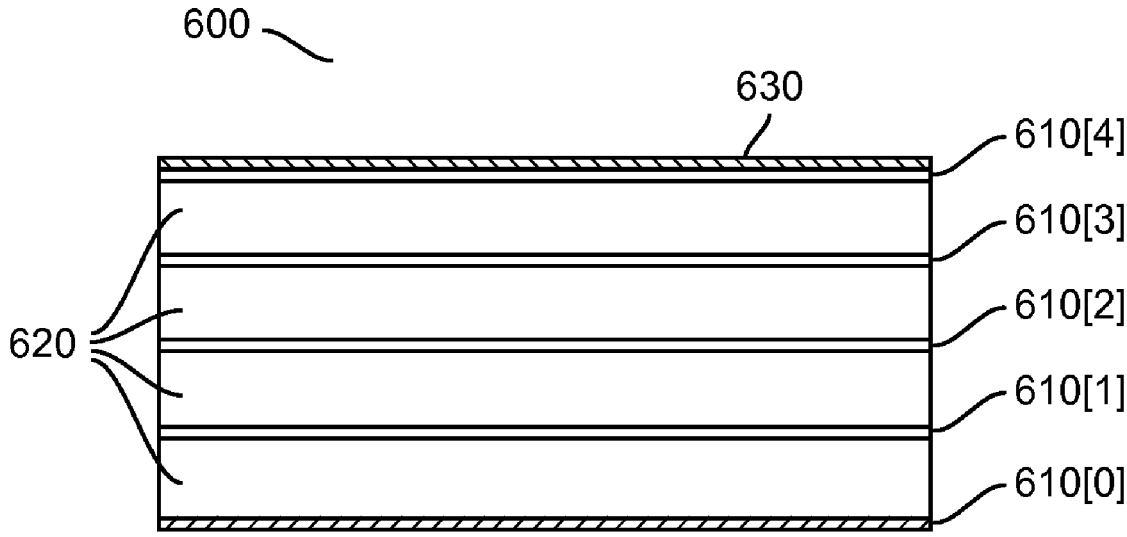
FIG. 6 illustrates an exemplary absorptive panel with a five layer structure.

FIG. 6 is a cross-sectional view of an exemplary absorptive panel 600 with a five layer structure. A bottom layer 610[0] is a metal sheet or metal thin film that is covered by a tough skin on the back side (not shown). The bottom layer 610[0] may adhere to the reflective panels, 530 and 540, of the portal structure 500 of FIG. 5. Layers 610[1:4] are resistive thin films set apart by low-loss spacers 620. Resistance values for these resistive thin film layers 610[1:4] are given as 247, 575, 1150 and 1150 ohm/square, respectively, for this exemplary absorptive panel 600. The low-loss spacer 620 has a thickness of 1" and can be made of foam or any other material that has a dielectric constant very near that of free space. There is a RF transparent tough skin 630 that adheres to the top resistive thin film layer 610[4]. In fact, the tough skin 630 may cover the entire absorptive panel 600 as a protective layer. For example, the tough skin 630 may be composed of ABS plastic. Simulations have shown that the absorptive panel 600 works very well for angles of incidence of +/−60 degrees at RFID frequencies, which is most suitable for the portal application. A skilled artisan may also appreciate variations of the absorptive panel 600, such as varying the number of layers and associated resistance values or thickness of the spacer 620.

Figure 7:
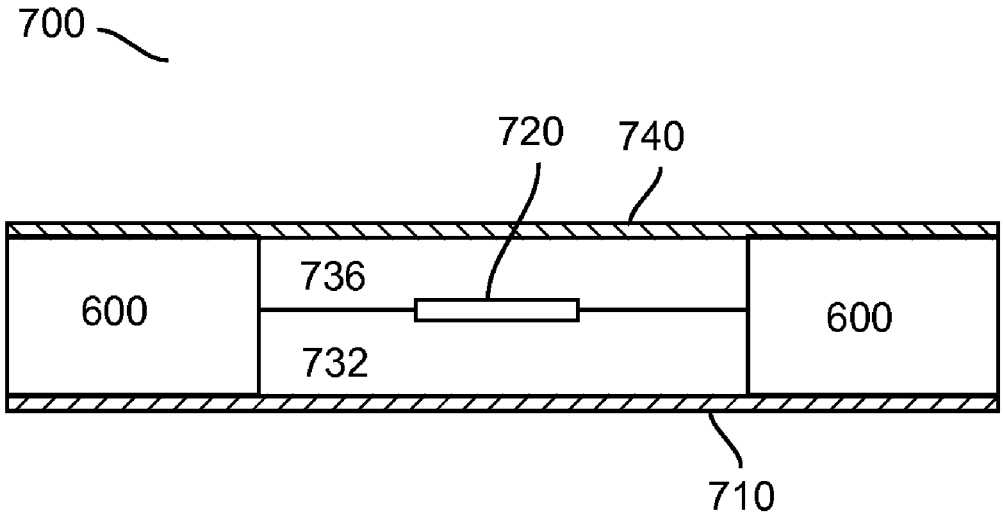
FIG. 7 is a cross-sectional view of a portal array antenna structure.

FIG. 7 is a cross-sectional view of a portal antenna structure 700 which comprises a metal ground plane 710, absorptive panels 600, a portal reader antenna system 720, foam spacers 732 and 736 and a RF transparent tough skin 740 covering the entire portal antenna structure 700. The portal reader antenna 720 may have angled radiators arranged in two arrays as shown in FIG. 3A. Since the portal reader antenna 720 is designed to operate in free space and not against a ground plane or an absorber, it is best to be positioned about 3" off the metal ground plane 710 via the spacer 732. The portal reader antenna 720 radiates a signal in both front and back directions. If the spacing is about 3", the back radiated signal will be reflected by the metal ground plane 710 and tend to add in phase with the front radiated signal to illuminate a pallet (not shown) in front of the portal antenna structure 700. As a result, this approach will provide much more power illuminating the pallet, which should result in much better excitation of the tagged items found within the pallet. As shown in FIG. 3A, the array antenna 310 provides polarization diversity as well as spatial diversity. The absorptive panels 600 absorb undesired signals reflected from the pallet, and also prevent direct radiated signals from leaking out of a portal structure (not shown). Note that the structure of FIG. 7 represents a sidewall shown in FIG. 5 which includes, for example, the reflective panel 530, the antenna 510 and absorptive panels 553 and 557.

Since this portal structure must be able to withstand bumpy situations associated with such warehouse applications, the whole structure must be made very durable to sustain outside impacts. As shown in FIG. 6, the absorptive panel 600 has already been designed to be structurally sound. The portal reader antenna 720 also has to be made with similar durability. This is accomplished by mounting the proposed portal reader antenna 720 in foam spacers 732 and 736 above the exposed section of the metal ground plane 710. At RFID frequencies, the thickness of the foam space 732 should be on the order of 3". The other foam spacer 736 is then attached on top of the portal reader antenna 720. Finally the tough, thin and RF transparent skin 740 encapsulates the entire portal antenna structure 700 to provide an outer protection against any abrasive impact.

In a typical warehouse application, the portal antenna structure 700 may be on the order of 4" to 5" thick, 5' to 12' tall and 3' to 10' wide. Because of materials used in its construction, it will be a relatively light-weight structure considering its size. It can be permanently mounted onto a fixed structure or installed on wheels for being easily moved around. The portal structure 500 that is built from the portal antenna panel 700 may have sensors for detecting an approaching or a leaving of a pallet. These sensors are used to control a reader system of the portal structure so that the reader system only reads tagged items within the pallet during the time that the pallet is within the portal structure. This is necessary because a pallet outside the portal will tend to scatter the RFID signal around the surrounding area and again create a significant environmental tag clutter, which is not acceptable. The portal sensor signals can be directly input to the reader system or to a system control computer. In either case, the reader is basically cleared of all tagged items before the pallet enters the portal. It then reads the tagged items until the pallet leaves the portal. In this way, the portal reader system focuses on tagged items within the pallet and minimizes false reads of tagged items disposed in the near vicinity of the portal structure but not on the pallet. Using this approach, the proposed portal structure is able to provide nearly 100% reads of the pallet tagged items and minimal reads of the tagged items not found on the pallet, which is the objective of this design.

The above illustrations provide many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A radio frequency identification (RFID) portal system, comprising:

a reader having a first antenna port;

a first antenna coupled to the first antenna port, comprising:

a first parallel-plate transmission line with a longitudinal span proximately equaling to a height of a space desired to be covered; and a first plurality of spaced radiating elements disposed on the first parallel-plate transmission line along the longitudinal span; and at least one RF energy absorptive panel for isolating the desired space from interference;

wherein tagged items are excited while the tagged items pass through the desired space.

2. The RFID portal system of claim 1, wherein the first parallel-plate transmission line comprises a first and second plate, the first plate being disposed closer to the desired space than the second plate, wherein the first plurality of spaced radiating elements are disposed on the first plate.

3. The RFID portal system of claim 2 further comprising a third plate substantially wider than the first and second plate, the third plate being disposed farther away from the desired space than the first and second plates, wherein backward radiations from the first plurality of spaced radiating elements are reflected into the desired space by the third plate.

4. The RFID portal system of claim 3, wherein the third plate is made of one piece of one or more conductive materials.

5. The RFID portal system of claim 2, wherein the first plurality of spaced radiating elements are protruding conductive strips coupled to the first plate, the coupling between the conductive strips and the first plate consisting of the group selected from electrical connection, capacitive coupling and inductive coupling.

6. The RFID portal system of claim 2, wherein the first plurality of spaced radiating elements are conductive patches coupled to the first plate, the coupling between the conductive patches and the first plate consisting of the group selected from electrical connection, capacitive coupling and inductive coupling.

7. The RFID portal system of claim 2, wherein the first plurality of spaced radiating elements are conductive loops coupled to the first plate, the coupling between the conductive loops and the first plate consisting of the group selected from electrical connection, capacitive coupling and inductive coupling.

8. The RFID portal system of claim 2, wherein the first plurality of spaced radiating elements are cut-outs from the first plate, the cut-outs consisting of the group selected from slots, notches and recesses.

9. The RFID portal system of claim 1, the first plurality of spaced radiating elements radiates in one or more predetermined polarization angles.

10. The RFID portal system of claim 9, wherein the one or more predetermined polarization angles are 45.degree.

11. The RFID portal system of claim 9, wherein the one or more predetermined polarization angles comprise a pair of cross-polarized angles.

12. The RFID portal system of claim 1, wherein the first plurality of spaced radiating elements have different dimensions for achieving uniform radiations from the first plurality of spaced radiating elements.

13. The RFID portal system of claim 1, further comprising:

a second antenna, comprising:

a second parallel-plate transmission line with a second longitudinal span proximately equaling to the height of the desired space, the second antenna being coupled to a second port of the reader, the second antenna being substantially parallel to, yet separated from the first antenna by a first predetermined distance in a horizontal direction; and a second plurality of spaced radiating elements disposed on the second parallel-plate transmission line along the second longitudinal span, vertically adjacent spaced radiating elements of both the first and second plurality of spaced radiating elements being separated by at least one second predetermined distance in the vertical direction.

14. The RFID portal system of claim 13, wherein the first and second predetermined distances are less than a wavelength of an operating RFID signal.

15. The RFID portal system of claim 13, wherein the first and second plurality of spaced radiating elements have cross-polarized radiations.

16. The RFID portal system of claim 1, wherein the RF energy absorptive panel is disposed substantially behind the first antenna away from the desired space.

17. The RFID portal system of claim 1, wherein the RF energy absorptive panel comprises a plurality of separated resistive layers.

18. The RFID portal system of claim 17, wherein the plurality of separated resistive layers are kept apart by low RF energy loss materials.

19. The RFID portal system of claim 13, wherein the second parallel-plate transmission line comprises a fourth and fifth plate, the fourth plate being disposed closer to the desired space than the fifth plate, wherein the second plurality of spaced radiating elements are disposed on the fourth plate.

20. The RFID portal system of claim 19, further comprising a sixth plate substantially wider than the fourth and fifth plate, the sixth plate being disposed farther away from the desired space than the fourth and fifth plates, wherein backward radiations from the second plurality of spaced radiating elements are reflected into the desired space by the sixth plate.

* * * * *